United States Patent [19]

Tomita

[11] 4,302,117

[45] Nov. 24, 1981

[54] HIGH SPEED VARIABLE INTENSITY PRINTING SYSTEM

[75] Inventor: Osamu Tomita, Hachioji, Japan

[73] Assignee: Fujitsu Limited, Japan

[21] Appl. No.: 46,167

[22] Filed: Jun. 7, 1979

[30] Foreign Application Priority Data

Jun. 12, 1978 [JP] Japan ..... 53/70578

[51] Int. Cl.[3] ..... B41J 1/32

[52] U.S. Cl. ..... 400/166; 400/320

[58] Field of Search ..... 400/157.3, 166, 320; 101/93.03

[56] References Cited

U.S. PATENT DOCUMENTS

| | | | |
|---|---|---|---|
| 3,628,644 | 12/1971 | Cralle et al. | 400/157.3 X |
| 3,712,212 | 1/1973 | Beery | 101/93.03 X |
| 3,858,509 | 1/1975 | Grundherr | 400/166 X |
| 3,866,533 | 2/1975 | Gilbert et al. | 101/93.03 X |
| 3,980,169 | 9/1976 | Decker et al. | 400/166 |
| 4,062,285 | 12/1977 | Deetz et al. | 101/93.03 X |
| 4,103,617 | 8/1978 | O'Brien et al. | 101/93.03 |
| 4,162,131 | 7/1979 | Carson et al. | 400/166 X |
| 4,162,858 | 7/1979 | Brandenburg | 400/166 X |
| 4,192,230 | 3/1980 | Blom et al. | 400/157.3 X |
| 4,192,619 | 3/1980 | Lau | 400/166 X |

OTHER PUBLICATIONS

IBM Technical Disclosure Bulletin, "Character Impression Control Mechanism", Engles, vol. 1 No. 4 Dec. 1958, p. 44.

IBM Technical Disclosure Bulletin, "Print Hammer Flight Time Variation Control", Barcomb et al., vol. 22 No. 8A Jan. 1980, pp. 3171-3172.

*Primary Examiner*—Ernest T. Wright, Jr.

*Attorney, Agent, or Firm*—Staas & Halsey

[57] ABSTRACT

The present invention relates to a high speed printing system, in which the printing intensity of each type element, applied onto a record media, is varied in accordance with the surface area of the type element. The system employs a double control mode, in each hammering operation, for carrying out the variation of the printing intensity. The double control mode is comprised of a first control mode and a second control mode, which follows immediately after the first control mode. In the first control mode, a maximum energizing current is supplied to a hammer means, comprising a dc motor, for hammering a selected type element to produce a desired character on the record media. In the second control mode, an energizing current is applied to the hammer means. The latter energizing current has variable peak amplitude which is suitable for carrying out fine control of the printing intensity in accordance with the size of the surface area of each type element.

14 Claims, 17 Drawing Figures

(a)
(b)
(c)
(d)
(e)
(f)
"1"
$t_0$
"0"
"0"
$t_1$
$V_{R1}$
$V_{R2}$
T1
T2
$t_S$
$t_H$
$t_D$

HIGH SPEED VARIABLE INTENSITY PRINTING SYSTEM

BACKGROUND OF THE INVENTION (1) Field of the Invention

The present invention relates to a high speed printing system and, more particularly, to a means for controlling a variable intensity printing applied to a record media.

(2) The Prior Art

In a printing system, it is necessary to vary the intensity of the printing which is applied to the record media in accordance with the size of the surface area of the characters. This is done in order to obtain high quality printed characters, having uniform deepness, regardless of the size of the surface area of the characters. In one prior art printing system a single control mode is employed for hammering each type element of the printer. In the single control mode, an energizing current having a constant amplitude is supplied to a hammer means during the flight of each type element toward a platen. However, the energizing current varies only when a type element selected to be hammered requires a respective predetermined printing intensity. The above mentioned prior art printing system has the following disadvantage: it is difficult to carry out a fine control of the printing impact and, accordingly, a fine control of the deepness. This is because, although the energizing current is slightly varied, the hammering speed of the type element at the platen and the flight time of the type element are widely varied.

Generally, there are two methods for hammering the type elements. In a first method, the hammering operation of a selected type element and the spacing operation of a carrier are performed alternately. This is the so-called intermittent printing method. The carrier contains a plurality of type elements and traverses back and forth along lines of the record media. On the other hand, in a second method, the hammering operation and the spacing operation are performed simultaneously. This is the so-called continuous printing method. That is, in the above mentioned first method, the carrier stops traversing every time it is located at the predetermined printing position and, then, the hammering operation follows; while, in the above mentioned second method, the hammering operation has commenced before the carrier reaches the predetermined printing position and, when the carrier reaches this printing position, the selected type on the carrier is impacted at the printing position on the record media. Therefore, the above mentioned second method is more suitable for employment in a high speed printing system than the above mentioned first method.

In a printing system employing either the first method or the second method the above-mentioned disadvantage arises when the single control mode is used to control the printing impact. As mentioned above, the disadvantage is that, although the energizing current is slightly varied, the intensity of the printing impact is widely varied, and as a result, fine control of the printing impact, and accordingly, fine control of the contrast appearing on the record media, can not be achieved. Furthermore, in a printing system employing the above mentioned second method the following disadvantage is created: the selected type element does not impact correctly at a predetermined printing position on the record media. This is because, although the energizing current is slightly varied, the flight time of the selected type element is widely varied.

SUMMARY OF THE INVENTION

It is an object of the present invention to provide a high speed printing system which creates no disadvantages similar to the aforesaid disadvantages.

In carrying out the above mentioned object, the printing system of the present invention employs a double control mode operation. The double control mode is comprised of a first control mode and a second control mode. In the first mode, a maximum energizing current is supplied to the hammer means, and in the second, which mode follows immediately after the first mode, a suitable energizing current for carrying out the fine control of the printing impact is supplied to the hammer means.

BRIEF DESCRIPTION OF THE DRAWING

The present invention will be more apparent from the ensuing description with reference to the accompanying drawing wherein.

DESCRIPTION OF THE PREFERRED EMBODIMENT

Figure 1:
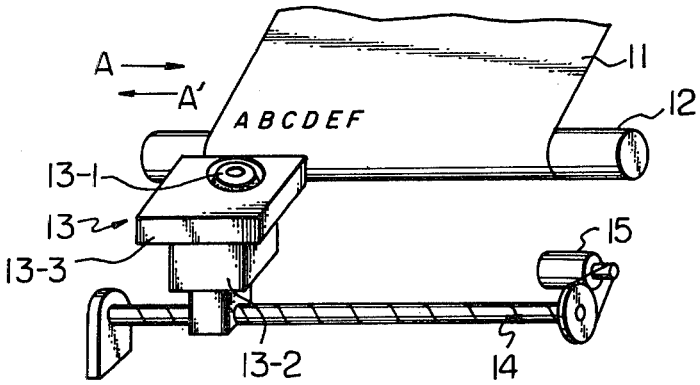
FIG. 1 is a partial perspective view of a conventional printing system.
Figure 2:
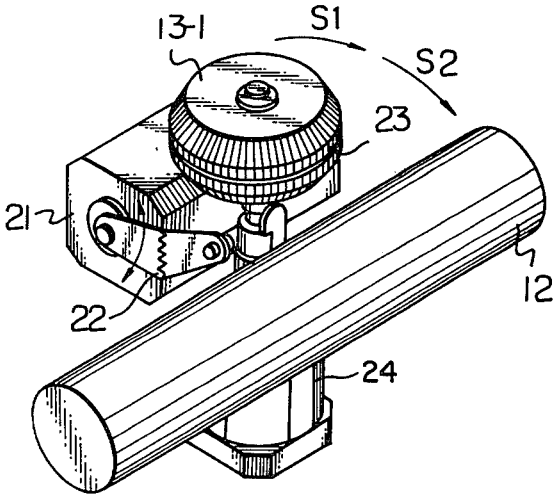
FIG. 2 is a perspective view of a hammer means, including a dc motor, used in a printing system to which the present invention is suitably and preferably applied.

In FIG. 1, which is a partial perspective view of a conventional printing system, the reference numeral 11 denotes a record media, such as a roll of paper, a bank book or the like. The record media 11 is supported by a platen 12 and fed intermittently in a direction perpendicular to the lines being printed on the record media 11. The reference numeral 13 denotes a carrier which hammers a selected type element 23 (FIG. 2). The carrier 13 includes a printing head 13-1, which contains a plurality of, for example one hundred and twenty eight, type elements 23 thereon. Half of the type elements 23 are arranged along and on an upper row and the other half thereof are arranged along and on a lower row. The upper and lower rows conform to the shape of the printing head 13-1 which has a crown shape. The carrier 13 also includes a driving mechanism 13-2, which is comprised of a motor 24 (FIG. 2) and a hammer means 21 (FIG. 2). The motor 24 is driven to rotate the printing head 13-1 so as to move the selected type element 23 in front of the record media 11, while the hammer means 21 hammers the selected type element 23 on the record media 11. The carrier 13 further includes a ribbon cartridge 13-3, which contains black and red ink ribbons (not shown). The spacing operation of the carrier 13 is performed along and by means of a space shaft 14 in the direction of arrow A in FIG. 1. Since a spiral groove is formed on the surface of the space shaft 14, the carrier 13 is traversed along the shaft 14 by engaging with the spiral groove when the shaft 14 is rotated by a space motor 15. Every time the printing head 13-1 finishes printing the last character to be printed on each line of the media 11, the head 13-1 is returned, together with the carrier 13, in the direction of arrow A' in FIG. 1, to its original position by rotating the shaft 14 in the opposite direction. A printed circuit board containing a circuit for controlling the above mentioned carrier 13, motors 24, 15, hammer means 21 and so on, is also located in the printing system, but is not shown in FIG. 1.

Above all, the present invention is directed to a means for controlling the printing head 13-1. Generally, the hammer means is made of a hammer magnet energized by solenoid coils, wherein the distance between the impact point on the platen 12 and the front face of the printing head 13-1 in idle condition is, for example, n1 [mm]. If the intention is to create a high speed printing system, it might appear that the hammer stroke of each type element 23 should simply be shortened. That is, simply shorten the distance n1 [mm] to a distance n2 [mm], where $n2<n1$. However, such a high speed printing system can not easily be realized only by shortening the distance from n1 [mm] to n2 [mm]. This is because, when the printing system is utilized in, for example a bank, bank books having various thicknesses must be inserted between the printing head 13-1 and the platen 12 by means of a so-called front-inserter or a so-called inserter-journal. At the same time guide means for feeding the bank book into the area between the printing head 13-1 and the platen 12 must also be employed in this printing system. As a result, if the length of the hammer stroke is shortened to the distance n2 [mm], said guide means can not be inserted between the platen 12 and the head 13-1. Consequently, said distance must be expanded to n1 [mm] when the bank book is initially inserted therebetween. After the bank book is introduced therebetween the guide means is pushed downward so as to facilitate carrying out the usual printing. Therefore, at this time the length of the hammer stroke can be shortened to the distance n2 [mm]. Specifically, during the idling condition of the head 13-1, the distance n1 [mm] is equal to 6 [mm], while during the working condition of the head 13-1, the distance n1 [mm] is equal to 3 [mm]. In other words the length of the hammer stroke changes to 3 [mm] and 6 [mm], alternatively. In order to produce the above two hammer strokes, two kinds of respective hammer magnets must be mounted on the carrier 13. Therefore, the carrier 13 becomes expensive and heavy. If the carrier 13 is heavy, the spacing operation will be conducted slowly, and as a result, high speed printing will not be obtained. Further, since each of the above mentioned hammer magnets must be provided with a return spring, the hammer magnets are always driven against the forces of the respective return springs. Accordingly, some of the hammer energy generated by each hammer magnet, is cancelled by the force of the corresponding return spring. Consequently, high speed printing can not be expected.

The present invention is suitably and preferably applied not to the printing system disclosed above, but to the following printing system. In the following printing system, the hammer means is not comprised of a hammer magnet, but of a dc motor 21 (FIG. 2), especially a servo-controlled dc motor, in order to overcome the defects of the above disclosed printing system. That is, the printing system to which the present invention is suitably and preferably applied, can freely select hammer strokes having various lengths and, the hammer energy is not cancelled by any force, such as the above mentioned force generated by the return spring.

In FIG. 2, which is a perspective view of the hammer means made of the dc motor used in the printing system to which the present invention is suitably and preferably applied, the reference numeral 21 denotes the dc motor. The printing head 13-1 is hammered by the dc motor 21, by way of sector gears 22, in the directions of the arrows S1 and S2. Accordingly, the dc motor 21 hammers a selected one of type elements 23 on the platen 12. The arrows S1 and S2 denote first and second hammer strokes, respectively. The lengths of the first and second hammer strokes are 3 [mm] each, and accordingly, the total length of these strokes is 6 [mm].

Figure 3:
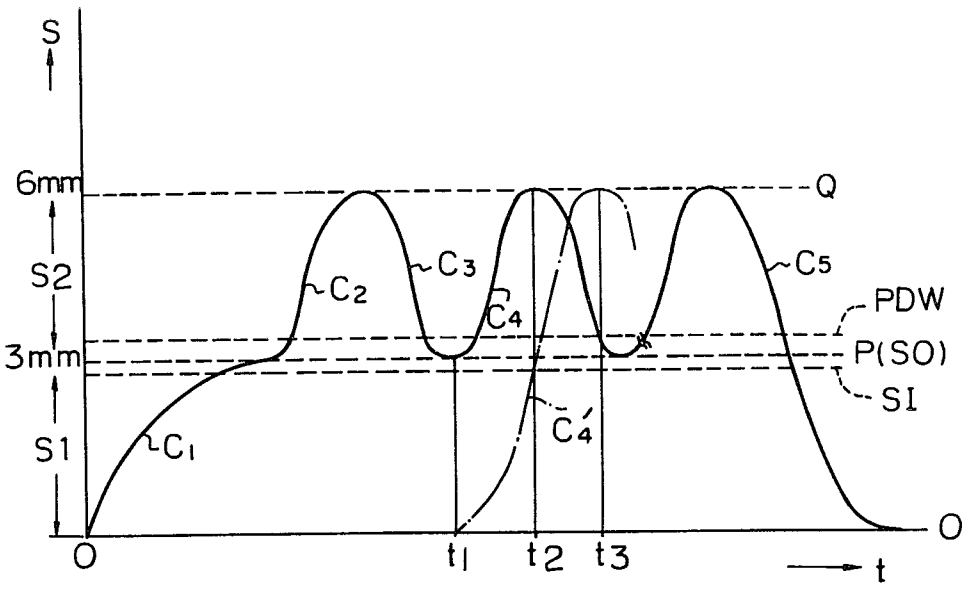
FIG. 3 is graph used to explain the operation of the hammer means illustrated in FIG. 2.

Referring to FIG. 3, which is a graph used for explaining the operation of the hammer means illustrated in FIG. 2, the operation of the hammer means, comprising the dc motor 21, will be explained below. In FIG. 3, the abscissa of the graph indicates a time "t" and the ordinate thereof indicates a length of a stroke "S". That is, the reference symbols S1 and S2 are identical to the S1 and S2, respectively, in FIG. 2. Firstly, when a command for hammering the printing head 13-1 is generated at the time $t=0$, the printing head 13-1 (see FIG. 2) is moved by the servo-controlled dc motor 21 (see FIG. 2), along a curve C1, toward the end of the first stroke S1. The end of the stroke S1 defines a floating stable position, as indicated by a dotted line P. Secondly, a selected one of the type elements 23, specified by respective printing data, is rotated into printing position by a conventional motor 24 and is moved, together with the printing head 13-1, along a curve C2, to a predetermined impact point on the platen 12 (see FIG. 2). This impact point is located on a line indicated by a dotted line Q. Thirdly, when successive second printing data is generated, the printing head 13-1 is returned not to an idling position indicated by a solid line 0, but to the floating stable position P, along a curve C3, by means of the servo-controlled dc motor 21. Fourthly, the selected type element 23, according to the second printing data, is moved together with the printing head 13-1 from the position P to a predetermined impact point on the platen 12 located on the line Q along a curve C4. In this case, the length of the hammer stroke is S2, that is, 3 [mm]. Consequently, the flight time required for flight along the curve C4 is shorter than the flight time which will be required for flight if the printing head 13-1 is moved along a curve C4', as is in usual system. The flight time along the curve C4 is (t2−t1), while the flight time along the usual curve C4' is (t3−t1), and accordingly the former flight time is shorter than the latter flight time by (t3−t2). Similarly, when third printing data is generated, the selected type element 23 is moved from the position P to the line Q. Thus, the printing head 13-1 is moved back and forth only along the second stroke S2, and accordingly, high speed printing is achieved. In FIG. 3, every time a last character on a line is printed on the record media 11, the printing head 13-1 is returned to the idling position, as indicated by the solid line 0, that is, the original position of the first stroke S1. Thereafter, the gap distance between the head 13-1 and the platen 12 changes to the length 6 [mm] so as to facilitate inserting a next bank book therebetween, if required. The reason this variable stroke operation can be achieved, is that the hammer means is the servo-controlled dc motor 21 (see FIG. 2).

Figure 4:
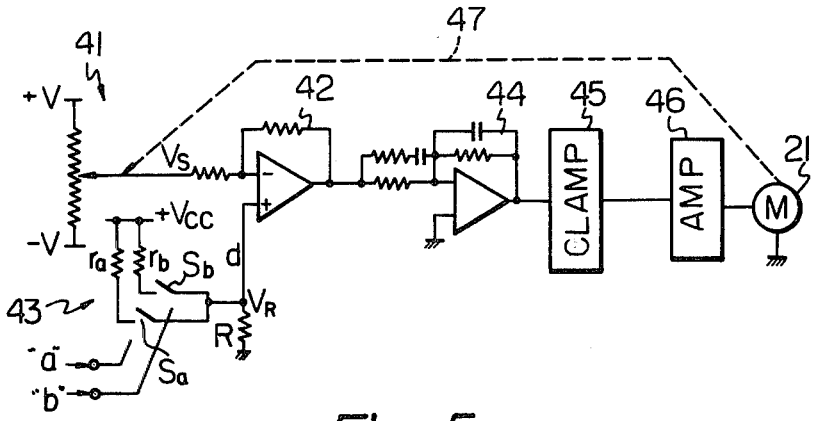
FIG. 4 is a circuit diagram of a drive circuit used to drive the dc motor 21 illustrated in FIG. 2.
Figure 5:
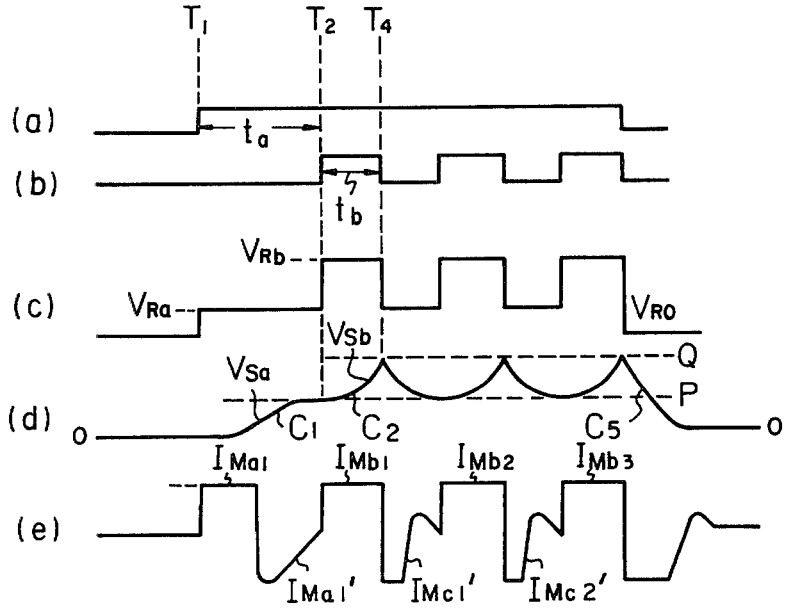
FIG. 5 contains timing charts used to explain the operation of the drive circuit illustrated in FIG. 4.

FIG. 4 is a circuit diagram of a drive circuit for driving the dc motor 21 illustrated in FIG. 2. FIG. 5 contains time charts used for explaining the operation of the above mentioned drive circuit of FIG. 4. In FIG. 4, the dc motor (M) 21 is the same as the dc motor 21 illustrated in FIG. 2. The reference numeral 41 denotes a potentiometer actuated by a rotor shaft (not shown) of the dc motor 21 (see dotted line 47). An output voltage $V_S$ from the potentiometer 41 is applied to an inverting input terminal of a differential amplifier 42. On the other hand, an output voltage $V_R$ from a variable reference voltage generator 43 is applied to a non-inverting input terminal of the amplifier 42. As a result, a difference voltage equal to the difference between the above two output voltages, that is $(V_R-V_S)$, is supplied to the dc motor 21 via a phase-compensation circuit 44, a clamp circuit 45 and a current amplifier 46. The dc motor 21 is servo-controlled by the above mentioned members so as to make the difference voltage $(V_R-V_S)$ zero.

Referring to FIG. 5, the operation of the drive circuit in FIG. 4 will now be explained. At the time $T_1$, a central processing unit (not shown) produces a command for hammering a selected type element 23 (see a command signal "a" in FIG. 4 and see (a) in FIG. 5). The command signal "a" closes a switch $S_a$ and, as a result, a reference voltage $V_R$ of the generator 43 becomes a voltage equal to $V_{CC}(R/R+r_a)$. This voltage $V_{CC}(R/R+r_a)$ is indicated by the symbol $V_{Ra}$ in (C) of FIG. 5. The dc motor 21 is driven, during a period $t_a$ (see (a) in FIG. 5), by an energizing current $I_{Ma1}$ (see (e) in FIG. 5), where $I_{Ma1}$ corresponds to a difference in voltage, between the voltage $V_S$ from the potentiometer 41 and the voltage $V_{Ra}$. This difference is obtained by means of the current amplifier 46. At this time, the energizing current $I_{Ma1}$ is supplied to the dc motor 21 during only the first half of the period $t_a$, and a brake current $I_{Ma1}$, (see (e) in FIG. 5) having negative polarity is supplied thereto during the remaining half of the period $t_a$. The brake current $I_{Ma1}$, having negative polarity is required to stably decelerate the rotation of the dc motor 21 until the rotation angle thereof reaches a desired rotation angle. Thus, the dc motor 21 is servo-controlled by the above currents $I_{Ma1}$ and $I_{Ma1}$, based on the so-called bang-bang control, and accordingly, the output voltage $V_S$ from the potentiometer 41 varies, during the period $t_a$, with a waveform $V_{Sa}$ (see (d) in FIG. 5). When the level of the voltage $V_{Sa}$ becomes the level of the $V_{Ra}(=V_{CC}(R/R+r_a)$, the printing head 13-1 is located at the floating stable position P (see FIGS. 3 and 5). The variation of the voltage $V_{Sa}$ corresponds to the curve C1 in FIG. 3. In (e) of FIG. 5, the peak amplitude of the energizing current $I_{Ma1}$ is maintained at a constant level. This constant level is defined by the clamp circuit 45 illustrated in FIG. 4 and, as a result, a uniform acceleration of the dc motor 21 can be achieved. Further, the brake current $I_{Ma1}$, varies from a negative level to a zero level with a predetermined waveform shown in (e) of FIG. 5. The predetermined waveform is created by the phase-compensation circuit 44 illustrated in FIG. 4. Specifically, the circuit 44 sums up an actual position signal, corresponding to the voltage $V_S$ in FIG. 4, and an actual velocity signal, which is obtained by differentiating the actual position signal. As a result, a stable servo-control of the dc motor 21 can be achieved.

Next, at the time $T_2$, the central processing unit produces a command for hammering a next selected type element 23 (see a command signal "b" in FIG. 4 and see (b) in FIG. 5). The command signal "b" closes a switch $S_b$ and, as a result, a reference voltage $V_R$ of the generator 43 becomes a voltage equal to $$V_{CC}\frac{R}{R+r_a//r_b}\left(r_a//r_b=\frac{r_ar_b}{r_a+r_b}\right).$$

Accordingly, the level of the reference voltage $V_R$ rises to the level of a voltage $V_{Rb}$ (see (c) in FIG. 5). Thereafter, the dc motor 21 is energized by a maximum energizing current and, at the same time, the printing head 13-1 is hammered with maximum energy toward the platen 12. The flight of the printing head 13-1 toward the platen 12 is schematically illustrated by a curve $V_{Sb}$ in (d) of FIG. 5, and also, this flight is schematically illustrated by a curve C2 in FIG. 3. In this period $t_b$, the energizing current corresponds to a current $I_{Mb1}$ in (e) of FIG. 5. Thereafter, if successive printing data is generated, the printing head 13-1 does not return to the idling position 0 (see the reference symbol 0 in (d) of FIG. 5 and see the line 0 in FIG. 3), but to the floating stable position P. The head 13-1 is returned to this position by supplying an energizing current $I_{Mc1}$, to the dc motor 21 and is settled at the stable position P, based on the aforesaid bang-bang control.

When the printing head 13-1 finishes printing the last character to be printed on the line of the record media 11, no command signals "a" and "b" are generated by the central processing unit. Accordingly, the switches $S_a$ and $S_b$ are opened, and the reference voltage $V_R$ (see FIG. 4) becomes zero (see the reference symbol $V_{R0}$ in (c) of FIG. 5). As a result, the dc motor 21 is rotated in the opposite direction, so as to bring the head 13-1 to the idling position 0. In this period the variation of the output $V_S$ from the potentiometer 41 is schematically illustrated by a curve C5 in (d) of FIG. 5, and also, by the curve C5 in FIG. 3. As will be understood from the above description, both the operation for moving the head 13-1 back and forth along the short stroke, that is 3 [mm], with high printing speed and the operation for turning back, if necessary, the head 13-1 to the idling position along the long stroke, that is 6 [mm], can be carried out by a single hammer means, that is, the dc motor 21.

Figure 6:
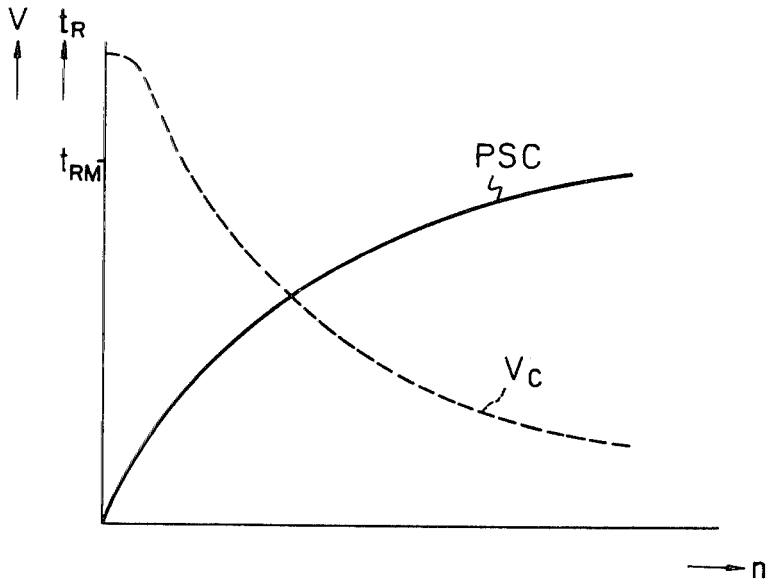
FIG. 6 is a graph indicating the relationships between a time $t_R$ for selecting a type element 23, in FIG. 2, and moving it in front of a platen 12, in FIG. 2, and the number of steps n for rotating a printing head 13-1 in FIG. 2.

Next, a method for determining spacing velocity and hammer timing, in a variable spacing operation, will be explained. Returning to FIG. 2, the selected one of the type elements 23 is moved in front of the platen 12 by rotating the printing head 13-1 n steps, from a present position of the printing head 13-1. The head 13-1 contains sixty four type elements, 23 on the upper row, arranged along its periphery, and also, contains the same number of type elements 23 on the lower row arranged along its periphery (see reference numeral 23 in FIG. 2). The heat 13-1 can rotate in a normal direction or reverse direction selectively and, accordingly, the head 13-1 is rotated by thirty two steps, which is one half of the sixty four steps, at maximum, when the type element 23 is moved to a facing position located in front of the platen 12. In other words, the head 13-1 must be rotated by thirty two steps when a type element 23 which is located farthest from said facing position is selected to be hammered. In the operation for moving the selected type element 23 to said facing position, a time ($t_R$) for selecting and moving the type element 23 to this facing position must be proportionally changed in accordance with the number (n) of said steps, which is lower than or equal to thirty two steps. FIG. 6 is a graph on which the relationship between the time $t_R$ and the number of steps n is plotted. The ordinate represents the time $t_R$ and the abscissa represents the number of steps n. In this graph, the curve PSC represents the relationship. The ordinate also represents a voltage (V), for specifying a spacing speed. As will be understood from the curve PSC, the relation between $t_R$ and n is expressed by an equation $t_R=\alpha f(n)$, where the item $\alpha f(n)$ is defined by $\alpha\sqrt{n}$.

On the other hand, in FIG. 1, a spacing time $t_S$ for performing each spacing operation is expressed by an equation $t_S=(LS/VS)$, when the carrier 13 is traversed forward by means of the space motor 15, via the shaft 14, where the symbol VS indicates the spacing speed and the symbol LS indicates a length of each space. Thus, the spacing time $t_S$ can be shorter than a maximum spacing time $t_{RM}$, which corresponds to the maximum number of steps, that is n=32. In other words, high speed printing can be achieved by determining the spacing time $t_S$ to be equal to the time $t_R$ with respect to every selection of the type element 23.

Since the time $t_R$ for each number of steps n is expressed by the above mentioned equation, that is $t_R=\alpha\sqrt{n}$, the spacing time $t_S$ may be determined by the equation $t_S=\alpha\sqrt{n}$, because the spacing time $t_S$ must be selected to be equal to $t_R$. As a result the spacing speed VS (corresponding to a curve $V_C$ in FIG. 6) can be expressed by an equation $VS=\beta\sqrt{n}^{-1}$, wherein $\beta=(LS/\alpha)$, because both equations $VS=(LS/t_S)$ and $t_S=\alpha\sqrt{n}$ exist as mentioned above. As will be understood from the above, critical high speed printing may be achieved in the printing system which is operated in accordance with the previously mentioned second method, that is the so-called continuous printing method. A circuit for controlling the space motor 15 (see FIG. 1), so as to drive the motor 15 in accordance with the above mentioned equation, $VS=\beta\sqrt{n}^{-1}$, can be easily realized by a person skilled in the art and is not disclosed in this specification. Furthermore, this circuit is not essential for the present invention.

Figure 7:
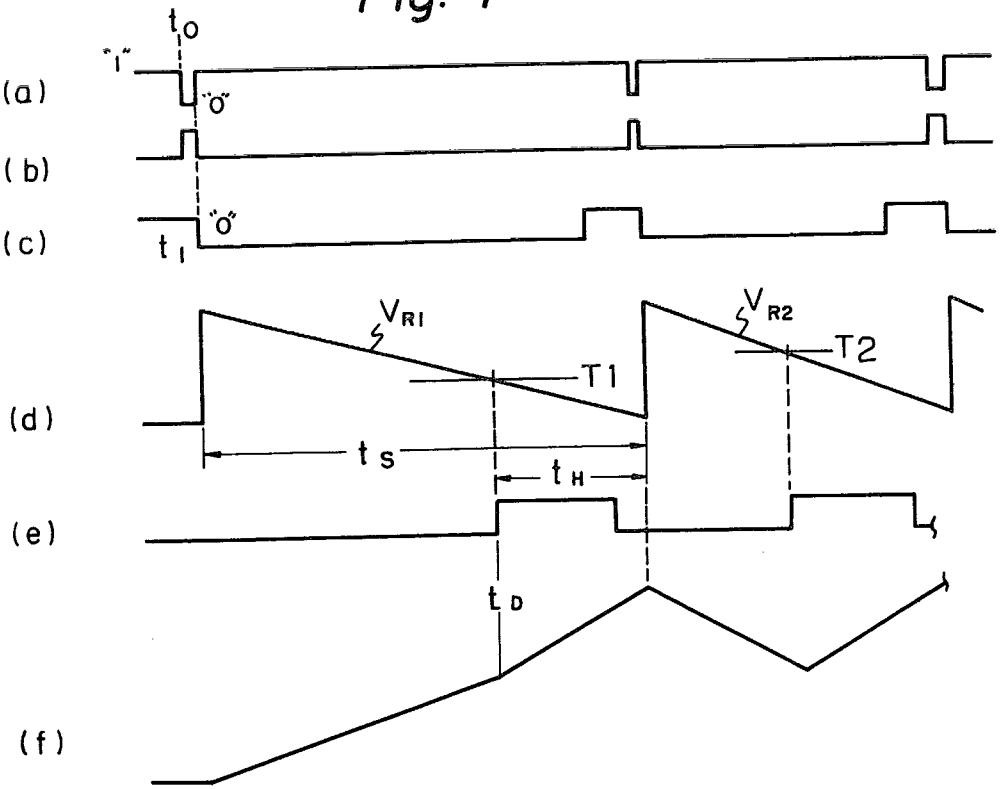
FIG. 7 contains timing charts used to explain the relationship between a spacing time $t_S$, a time $t_H$ for energizing the dc motor 21 and a hammer firing timing $t_D$.
Figure 8:
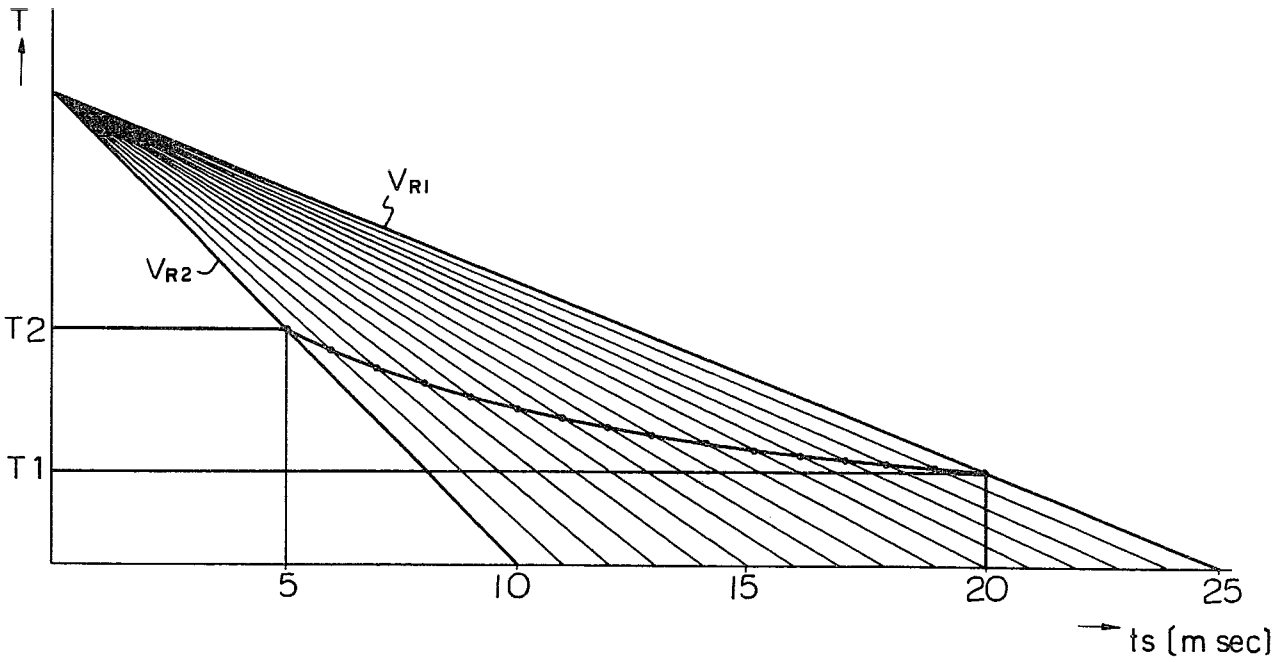
FIG. 8 is a graph used to explain the method for determining threshold levels T1 and T2 indicated in (d) in FIG. 7.

As mentioned above, the spacing time $t_S$ is determined by the time $t_R$. Accordingly, a hammer firing timing ($t_D$) must also be determined in accordance with time $t_R$, which is the time for selecting each type element 23 and moving it to the facing position located in front of the platen 12. The hammer firing timing $t_D$ is expressed by an equation $t_D=t_S-t_H$, for which the symbol $t_S$ has been explained before and the symbol $t_H$ indicates a time for energizing the dc motor 21, which time $t_H$ is fixedly determined to be, for example 5 [msec]. FIG. 7 contains timing charts used for explaining the relation between the times $t_S$, $t_H$ and the hammer firing timing $t_D$. Referring to FIG. 7, at the time $t_0$, the logic of a mecha-busy signal is changed from logic "1" to logic "0" (see (a)) by the central processing unit, when printer members, illustrated in FIGS. 2 and 4 finish printing the last character. Thereafter, the printer members are reset to the so-called mecha-ready state. During the mecha-ready state, the printing data is supplied to the printer members from the central processing unit (see (b)). Simultaneously, at the time $t_1$, the printer members start carrying out both the spacing operation and the operation for selecting one desired type element 23, and moving it to the facing position (see (c) and (d)). In (c), the logic "0" represents the status in which the latter operation is being carried out. The waveform in (d) shows the variation of a signal ($V_R$), which indicates the difference value between a static space value specified by the central processing unit in advance and a dynamic space value representing a present position of the printing head 13-1 (see FIG. 1) along each line of the record media 11. In (d), two different triangle signals $V_{R1}$ and $V_{R2}$ are shown. The signal $V_{R1}$ will be obtained when the number of steps n, by which steps n the type element 23 is moved to the facing position, is relatively large. The signal $V_{R2}$ will be obtained when the number of steps n is relatively small. In (d) and (e), the symbol $t_S$ denotes the aforesaid spacing time $t_S$, the symbol $t_H$ denotes the aforesaid time for energizing the dc motor 21 and the symbol $t_D$ denotes the aforesaid hammer firing timing, where the time $t_H$ is constant, for example 5 [msec]. The hammer firing timing $t_D$ is determined as the moment when the levels of the signals $V_{R1}$ and $V_{R2}$, respectively, cross threshold levels T1 and T2. Each of the threshold levels T1 and T2 has been predetermined in such a manner that the above mentioned moment occurs $t_H$ [msec] before a time when the type element 23 will impact on a predetermined respective printing position of the record media 11. Therefore, the threshold level is relatively high, such as T2, when the spacing velocity is relatively high, such as $V_{R2}$, while the threshold level is relatively low, such as T1, when the spacing velocity is relatively low, such as $V_{R1}$. As a result, the dc motor 21 can always be energized at the timing $t_D$, which exists $t_H$ msec before the time when the type element 23 will impact on the record media 11. The waveform of (f) represents the locus of the flight of printing head 13-1, wherein the printing head 13-1 is accelerated during the time $t_H$ and impacts against the corresponding printing position at the end of the time $t_H$. It should be noted that the end of the time $t_H$ always coincides with the end of the spacing time $t_S$. This is because, the threshold levels, such as T1, T2, have already been determined in advance, as mentioned above, based on test data which are obtained by experiment. These test data are plotted in curves shown in FIG. 8. In the graph of FIG. 8, the abscissa indicates the spacing time $t_S$ and the ordinate indicates the threshold level T, such as T1 and T2, in (d) of FIG. 7. In FIG. 8, test data curves $V_{R1}$ and $V_{R2}$, respectively, correspond to the signals $V_{R1}$ and $V_{R2}$ in (d) of FIG. 7. In the graph of FIG. 8, each of the curves represents the aforesaid difference signal $V_R$, which indicates the difference between the specified static space value and the dynamic space value, and each curve is obtained for a respective number of steps n (n=32). In this graph, only sixteen curves are shown for the respective sixteen steps among the thirty two steps. As will be understood from FIG. 8, if the spacing time $t_S$ is selected to be a minimum value, for example 10 [msec], the threshold level T2 should be determined by the point on the curve $V_{R2}$ which is defined by the spacing time $t_S$ of 5 [msec], which is 5 [msec] (corresponding to $t_H$) before the spacing time 10 [msec]. If the spacing time $t_S$ is selected to be the maximum value, that is 25 [msec], the threshold level T1 should be determined by the point on the curve $V_{R1}$ which is defined by the spacing time $t_S$ of 20 [msec], which is 5 [msec] (corresponding to $t_H$) before the spacing time 25 [msec].

The essential features of the present invention will now be described. It should be noted that the basic concept of the present invention can be applied to any printing system, however, the present invention is suitably and preferably applied to the printing system described in detail hereinbefore. As previously mentioned, the intensity of the printing impact is varied in order to produce characters having a uniform contrast with each other, regardless of the size of the surface areas of the type elements 23. The variation of the intensity of the printing impact is controlled, in the prior art, by the single control mode. In contrast, in the present invention, the variation thereof is controlled by a new double control mode. The prior art single control mode is carried out in two typical ways. A first typical way of carrying out the single control mode has been disclosed in, for example U.S. Pat. No. 3,712,212 or the I.B.M. Technical Disclosure Bulletin Volume 1, Number 4, page 44, J. D. Engles, December 1958. A second typical way of carrying out the single control mode has been disclosed in, for example the U.S. Pat. No. 3,858,509. In the above mentioned first typical single control mode, a peak amplitude of the current energizing the hammer means, is varied in accordance with the variation of the surface areas of the type elements. In the above mentioned second typical single control mode, a pulse width of the energizing pulse current, for energizing the hammer means, is varied in accordance with the variation of the surface areas of the type elements. Thus, if the size of the surface area is large, for example the type element "W", the peak amplitude of the energizing current is set to be very high or the pulse width of the energizing pulse current is set to be very wide. Contrary to this, if the size of the surface area is small, for example the type element ".", the peak amplitude of the energizing current is set to be very low or the pulse width of the energizing pulse current is set to be very narrow.

Figure 9A:
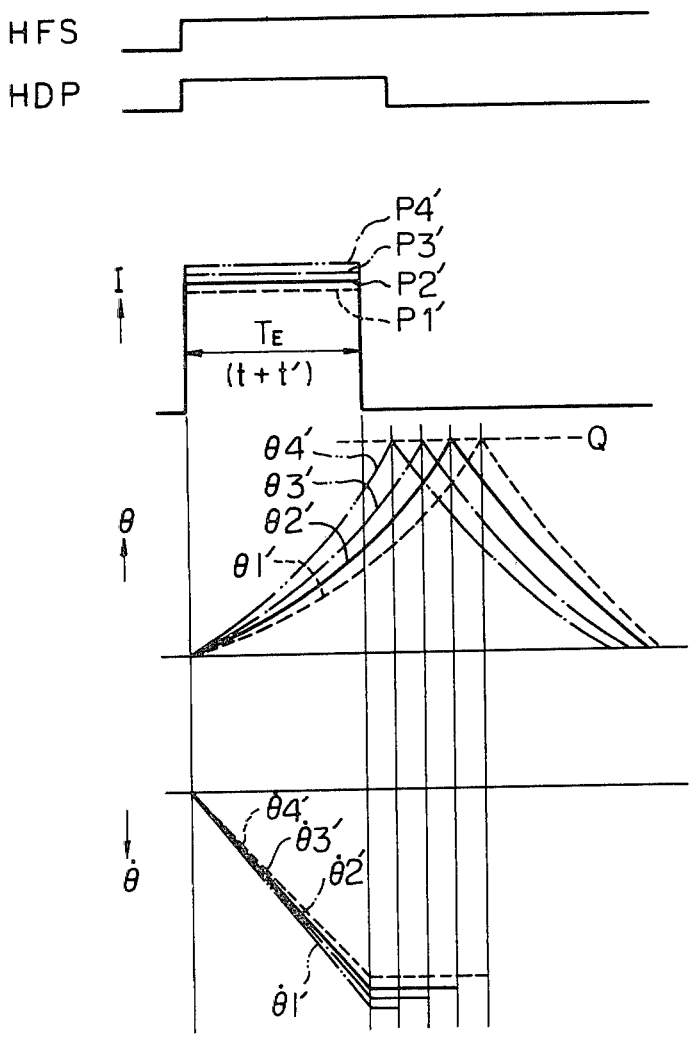
Fig. 9A PRIOR ART
FIG. 9A contains explanatory waveforms for illustrating a prior art single control mode.

The above mentioned first typical single control mode will be clarified by referring to explanatory waveforms shown in FIG. 9A. While, the double control mode, according to the present invention, will be clarified by referring to explanatory waveforms shown in FIG. 9B. In FIG. 9A, the peak amplitude of the energizing current I, which is applied to the hammer means, varies with the peak amplitudes, such as P1', P2', P3' and P4', in accordance with the variation of the surface areas of the type elements. When the peak amplitude varies with the values P1', P2', P3' and P4', the displacement $\theta$ of the printing head varies along curves $\theta 1'$, $\theta 2'$, $\theta 3'$ and $\theta 4'$, respectively. A dotted line Q is identical to the dotted line Q in FIG. 3. Accordingly, the hammering velocity $\theta$ of the printing head varies along curves $\dot{\theta} 1'$, $\dot{\theta} 2'$, $\dot{\theta} 3'$ and $\dot{\theta} 4'$ with respect to the curves $\theta 1'$, $\theta 2'$, $\theta 3'$ and $\theta 4'$, respectively.

Figure 9B:
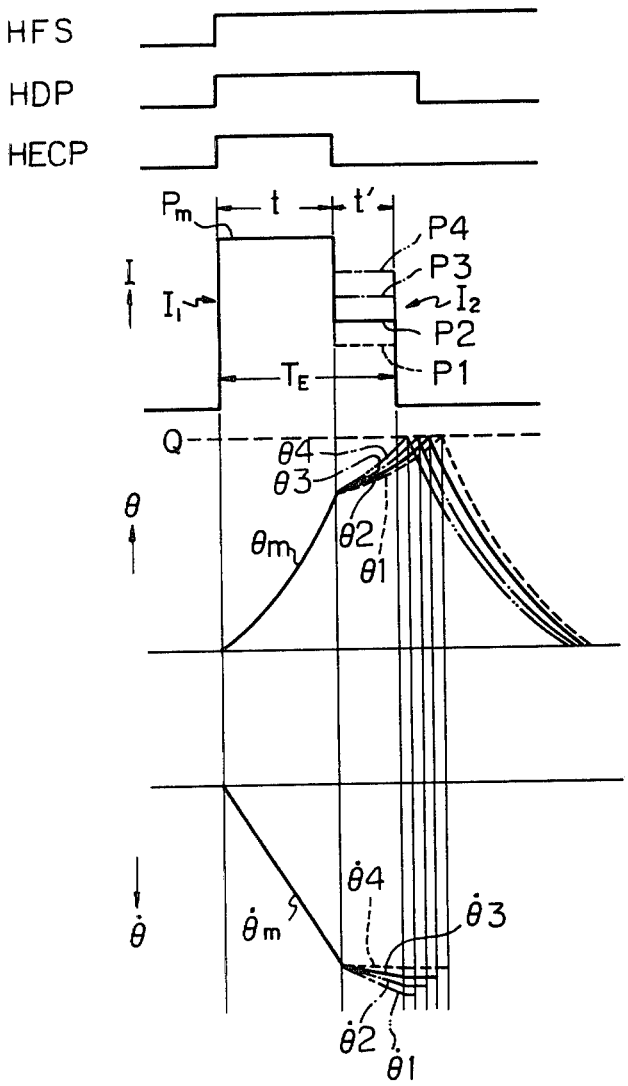
FIG. 9B contains explanatory waveforms for illustrating a double control mode according to the present invention.

In contrast, the corresponding waveforms according to the present invention are different from those of the prior single control mode, as shown in FIG. 9B. In FIG. 9B, the energizing current I, which is applied to the dc motor 21 (see FIG. 2), is composed of both a first energizing current $I_1$ and a second energizing current $I_2$. The first energizing current $I_1$ has a maximum peak amplitude $P_m$, regardless of the size of the surface area of the selected type element 23. The first energizing current $I_1$ is applied during, for example, about one half of an energizing time $T_E$, to the dc motor 21. While, the peak amplitude of the second energizing current $I_2$ varies according to the size of the surface area of the selected type element 23. The displacement $\dot{\theta}$ of the printing head 13-1 (see FIG. 2) varies along a curve $\dot{\theta}_m$, which defines a constant locus of the printing head 13-1, during the time when the first energizing current $I_1$ is supplied to the dc motor 21. The displacement $\dot{\theta}$ of the printing head 13-1 varies along curves $\dot{\theta} 1$, $\dot{\theta} 2$, $\dot{\theta} 3$ and $\dot{\theta} 4$, respectively, when the peak level of second energizing current $I_2$ varies with the values P1, P2, P3 and P4, according to the size of the surface areas of the selected type elements 23. Accordingly, the hammering velocity $\theta$ of the printing head 13-1 varies along a curve $\theta_m$ during the application of the current $I_1$ to the motor 21, whle the hammering velocity $\theta$ varies along curves $\theta 1$, $\theta 2$, $\theta 3$ and $\theta 4$ with respect to the curves $\theta 1$, $\theta 2$, $\theta 3$ and $\theta 4$, respectively.

Figure 10A:
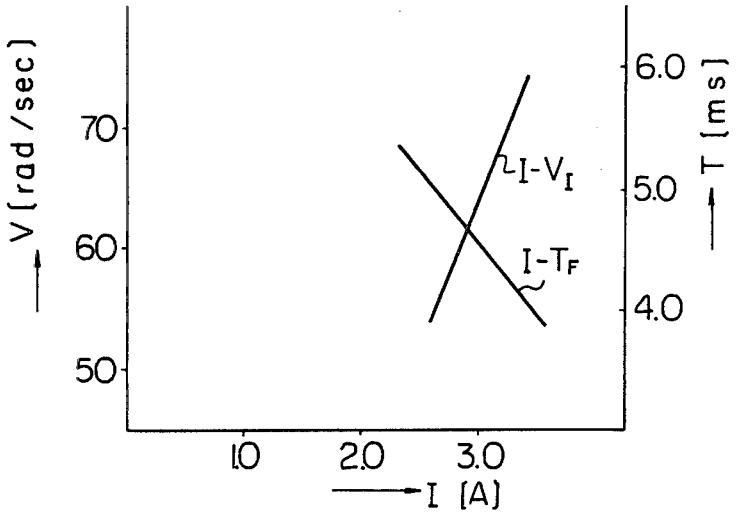
Fig. 10A PRIOR ART
FIG. 10A is a graph indicating both a variation of a flight time $T_F$ of a type element and a variation of an impact velocity $V_I$ with respect to a variation of a driving current I, respectively, obtained in the prior art single control mode.
Figure 10B:
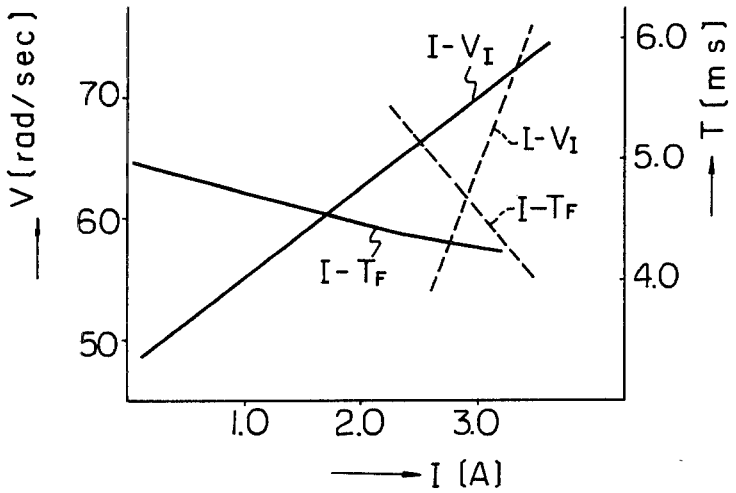
FIG. 10B is a graph indicating both a variation of a flight time $T_F$ of a type element and a variation of an impact velocity $V_I$ with respect to a variation of a driving current I, respectively, obtained in the double control mode according to the present invention.

The double control mode according to the present invention has the merits mentioned below when compared with the prior single control mode. FIG. 10A is a graph showing both a variation of a flight time $T_F$ of the type element and a variation of an impact velocity $V_I$ with respect to a variation of the energizing current I, respectively, obtained in the prior single control mode. FIG. 10B is a graph showing both a variation of a flight time $T_F$ of the type element 23 and a variation of an impact velocity $V_I$ with respect to a variation of the energizing current I, respectively, obtained in the double control mode according to the present invention. Especially, the energizing current I of FIG. 10B represents the second energizing current $I_2$ (see FIG. 9B). Further, the I-$V_I$ and I-$T_F$ characteristics represented by dotted lines in FIG. 10B are identical to those shown by solid lines in FIG. 10A. As will be understood from FIG. 10A, in the prior art single control mode, when the energizing current I is slightly varied, both the impact velocity $V_I$, that is the printing impact energy, and the flight time $T_F$ are widely varied. Accordingly, a fine control of the printing impact, that is a fine control of the contrast of the printed characters, is very difficult to carry out. This is because the impact velocity $V_I$ varies sharply, and also, an accurate timing control (refer to FIG. 7) for carrying out the high speed continuous printing can not be expected, because the flight time $T_F$ varies sharply with respect to the variation of the energizing current.

In contrast, as will be understood from FIG. 10B, in the double control mode according to the present invention, when the energizing current I is slightly varied, both the impact velocity $V_I$, that is the printing impact energy, and the light time $T_F$ are also slightly varied. Accordingly, a fine control of the printing impact, that is a fine control of the deepness, can be achieved, because the impact velocity $V_I$ varies by a wide margin, and because an arcuate timing control (refer to FIG. 7) for carrying out the high speed continuous printing can be expected, because the flight time $T_F$ varies by a wide margin with respect to the variation of the energizing current I.

Differences between the single control mode and the double control mode will now be further explained.

In the single control mode, the following equations 1 and 2 are obtained.

$$\dot{\theta}' = \frac{K_T \cdot I_3}{J}(t + t') \quad 1$$

$$\theta = \frac{K_T \cdot I_3}{2J}(t + t')^2 \quad 2$$

Where $\dot{\theta}'$ is the impact velocity (see FIG. 9A), $\theta'$ is the displacement (see FIG. 9A), $I_3$ is the peak amplitude of the energizing current I (see FIG. 9A), $(t+t')$ is the same as the energizing time $T_E$ (see FIG. 9A), J denotes the moment of inertia of the hammer means including the printing head and $K_T$ denotes a torque constant factor of the same.

In the double control mode, the following equations 3 and 4, similar to the above equations 1 and 2, are obtained.

$$\dot{\theta} = \frac{K_T}{J}(I_2 t' + I_1 t) \quad 3$$

$$\theta = \frac{K_T \cdot I_2}{2J} t'^2 + \frac{K_T \cdot I_1}{J} t \cdot t' + \frac{K_T \cdot I_1}{2J} t^2 \quad 4$$

Symbols which are the same as those used in the above equations 1 and 2, have identical meanings, and, $I_1$ and $I_2$ represent the peak amplitudes of the first and second energizing currents (see FIG. 9B), respectively.

In a case where the energy of $I_3$ and the total energy of $I_1$ and $I_2$ are equal, the following equation 5 is obtained.

$$I_3(t+t') = I_1 t + I_2 t' \quad 5$$

If we calculate the difference $(\dot{\theta}' - \dot{\theta})$, it is expressed by the following equation 6, by utilizing the above equations 1 and 3.

$$\theta' - \dot{\theta} = \frac{K_T}{J}\{(I_3 - I_1)t + (I_3 - I_2)t'\} \quad 6$$

Then, we obtain $\dot{\theta}' - \dot{\theta} = 0$ by combining the above equations 5 and 6. As a result, we can conclude that the impact velocity $\dot{\theta}'$ obtained in the single control mode is the same as the impact velocity $\dot{\theta}$ obtained in the double control mode, in a case where the same energizing energy is applied to each hammer means during the same energizing time $T_E(=t+t')$.

However, in a case where the same energizing energy is applied to each hammer means during the same energizing time $T_E$, the displacement $\theta$ (see FIG. 9B) in the double control mode is larger than the displacement $\theta'$ (see FIG. 9A) in the single control mode. In other words, the flight time $T_F$ in the double control mode can be shorter than the flight time $T_F$ in the single control mode, if the lengths of the hammer strokes both in the single and double control modes are set to be equal to each other. The above mentioned fact that the displacement $\theta$ is larger than the displacement $\theta'$, is proved by the following. The difference $(\theta' - \theta)$ is derived from the above equations 2 and 4 and expressed by the following equation 7.

$$\theta' - \theta = \frac{K_T I_3}{2J}(t + t')^2 - \frac{K_T \cdot I_2}{2J} \cdot t' - \frac{K_I I_1}{J} t \cdot t' - \frac{K_T \cdot I_1}{2J} t^2 \quad 7$$

$$= (I_3 - I_1)t^2 - 2(I_3 - I_1)t \cdot t' + (I_3 - I_2)t'^2$$

The above equation 7 is reformed as the following equation 8, by using the above equation 5.

$$\theta' - \theta = \frac{(I_2 - I_1)(I_2 - I_3)}{I_3 - I_1} \quad 8$$

In this equation 8, since the relations $I_1 > I_3 > I_2$ exist, the difference $(\theta' - \theta)$ becomes negative $(\theta' < \theta)$. Therefore, the displacement $\theta$ in the double control mode is larger than the displacement $\theta'$ in the single control mode under the conditions that both the energizing energies and both the energizing times, in the single and double control modes, are the same. Thus, the remarkable advantage of the double control mode resides in the fact that, compared to the single control mode, the flight time $T_F$ in the double control mode is shorter than the flight time $T_F$ in the single control mode when the respective hammer strokes are equal to each other. In other words, the hammer stroke in the double control mode can be longer than the hammer stroke in the single control mode when the respective flight times are equal to each other.

Figure 11:
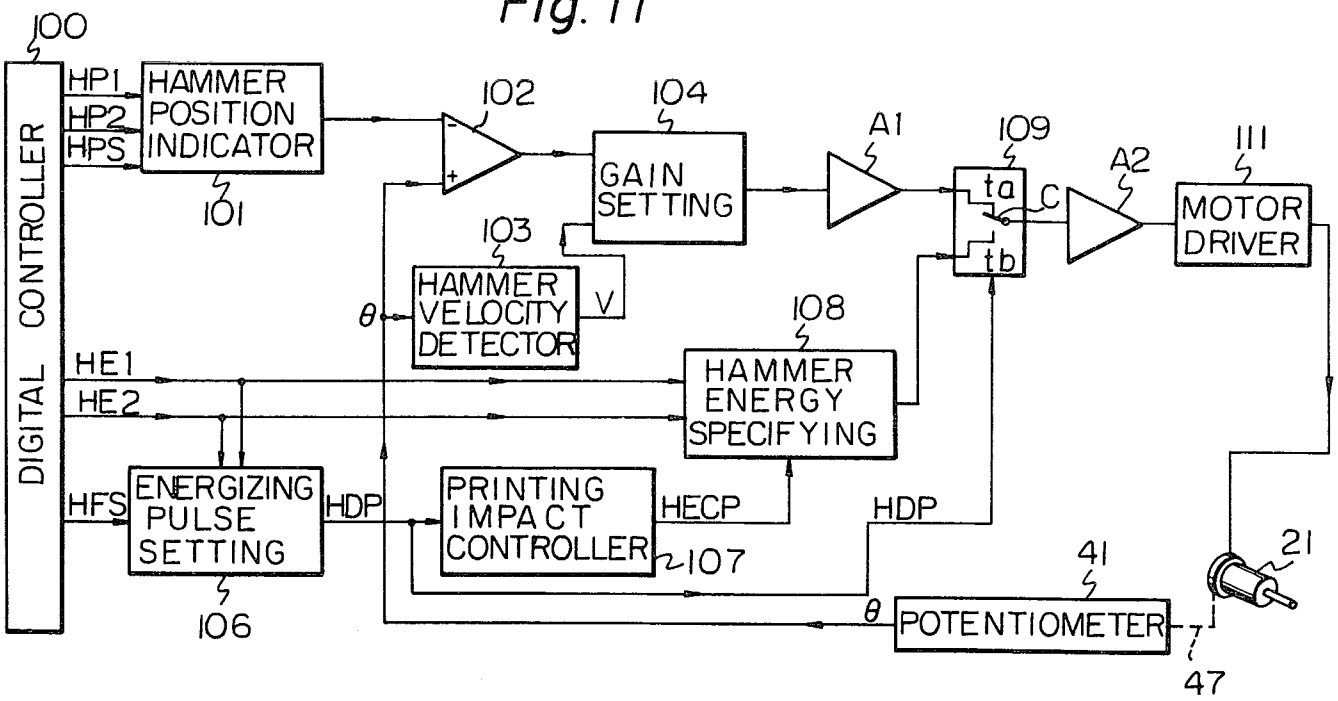
FIG. 11 is a block diagram of a circuit for carrying out the double control mode of the present invention.
Figure 12:
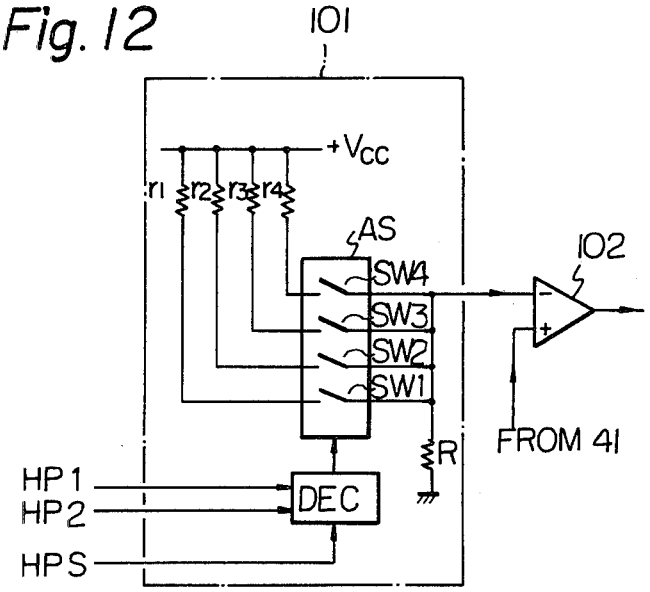
FIG. 12 is a circuit diagram illustrating a detailed example of a hammer position indicator 101 illustrated in FIG. 11.

FIG. 11 is a block diagram of a circuit for carrying out the double control mode according to the present invention. In FIG. 11, the dc motor 21, (see FIG. 2) for hammering the printing head 13-1 (see FIG. 2), is located on the bottom right side. The reference numeral 100 indicates a digital controller 100. The digital controller 100 produces various kinds of signals. The signals are two bits of hammer position signals HP1 and HP2, one bit of a hammer position signal HPS, two bits of hammer energy specifying signals HE1 and HE2 and a hammer firing signal HFS. The signals HP1, HP2 and HPS are applied to a hammer position indicator 101. A detailed example of the hammer position indicator 101 is illustrated in FIG. 12, wherein the reference symbols AS indicates an analogue switch, SW1 through SW4 indicate switches, R and r1 through r4 indicate resistors, and DEC indicates a decoder. Returning to FIG. 11, the output from the indicator 101 is applied to an inverting input terminal of a differential amplifier 102. Regarding the above signals HP1, HP2 and HPS, to be applied to the indicator 101, when the signal HPS is logic "0", the signals HP1 and HP2 are not decoded by the decoder DEC (see FIG. 12), and the indicator 101 indicates that the printing head 13-1 should be located at the idling position (see the solid line 0 in FIG. 3). When the signal HPS is logic "1", the signals HP1 and HP2 are decoded by the decoder DEC. The signals HP1 and HP2 can specify four kinds of positions, at any of which the floating stable position (see the dotted line P in FIG. 3) should be located. In this embodiment of the present invention, the intensity of the printing impact is classified into four levels, that is "VS" (very strong), "S" (strong), "M" (medium) and "W" (weak). The signals HP1 and HP2, having the logic (00), are provided in the case where one of the type elements 23 which are arranged on the upper row (see FIG. 2), that is, the so-called shift-in type element 23 (SI) is specified by the central processing unit, and also, in the case where a type element 23 to be printed with the intensity of "VS", "S" or "M" is specified by the central processing unit. The signals HP1 and HP2 having the logic (01) are provided in the case where a shift-in type element 23 to be printed with the intensity of "W" is specified by the central processing unit. The signals HP1 and HP2 having logic (10) are provided in the case where one of the type elements 23 which is arranged on the lower row (see FIG. 2), that is the so-called shift-out type element 23 (SO) and in the case where a selected type element 23 is printed with the intensity of "VS", "S" or "M", is specified by the central processing unit. The signals HP1 and HP2 having logic (11) are provided in the case where the shift-out type element 23 (SO) to be printed with the intensity of "W" is specified by the central processing unit. Thus, the signals HP1 and HP2 specify, the floating stable positions SI, SO which are the same as P, and PDW indicated by respective dotted lines in FIG. 3. The position PDW is specified by the signals HP1 and HP2 having logic (11) or (01). In FIG. 11, the differential amplifier 102 also receives, at its non-inverting input terminal, the output from the potentiometer 41, which is also illustrated in FIG. 4. The potentiometer 41 cooperates with the rotor shaft of the dc motor 21 and produces the displacement signal $\theta$ (see FIG. 9B). Accordingly, the amplifier 102 produces a difference signal between the present displacement $\theta$ and the position which was previously specified by the signals HPS, HP1 and HP2. A hammer-velocity detector 103 produces, by differentiating the present displacement signal $\theta$, a hammer-velocity indicating signal V. A gain setting circuit 104 receives both the present displacement signal $\theta$ and the hammer-velocity indicating signal V and processes these signals $\theta$ and V in accordance with a binominal expression $k_1 \cdot \theta + k_2 \cdot V$, where $k_1$ and $k_2$ are constant. The circuit 104 is useful for varying the gain in accordance with the curves C1, C2, C3, C4 and C5 (see FIG. 3). The output from the circuit 104 is applied to an analogue switch 109 via an amplifier A1. It should be noted that the arrangement composed of the above mentioned members 101, 102, 41, 103, 104 and A1 has already been known in the art to which the present invention pertains.

Figure 13:
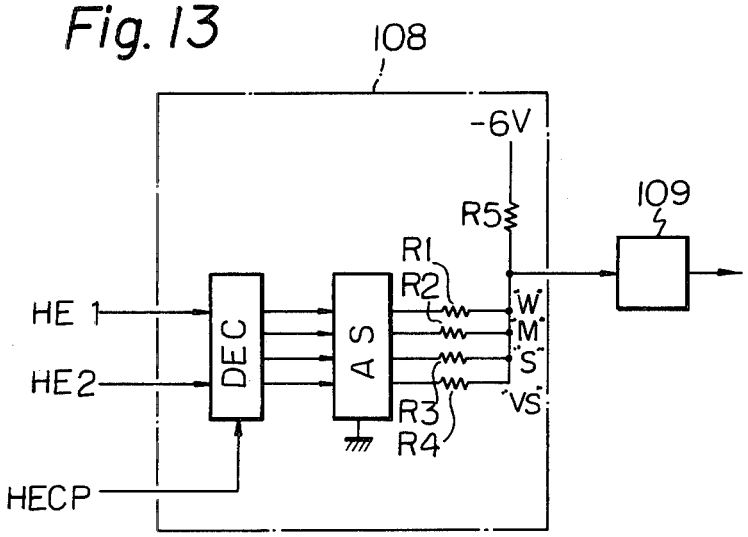
FIG. 13 is a circuit diagram illustrating a detailed example of a hammer energy specifying circuit 108 illustrated in FIG. 11.

The reference numeral 106 indicates an energizing pulse setting circuit. The circuit 106 receives the hammer firing signal HFS (refer to FIG. 9B) and hammer energizing signals HE1 and HE2 from the digital controller 100, and produces a hammer driving pulse HDP (refer to FIG. 9B). The reference numeral 107 indicates a printing impact controller. The controller 107 receives the pulse HDP from the circuit 106 and produces a hammer energy controlling pulse HECP (refer to FIG. 9B). The reference numeral 108 indicates a hammer energy specifying circuit. The circuit 108 also receives the above mentioned hammer energizing signals HE1 and HE2 from the digital controller 100, and produces a two-step voltage signal which corresponds to the first and second energizing currents $I_1$ and $I_2$ (refer to FIG. 9B). A detailed example of the hammer energy specifying circuit 108 is illustrated in FIG. 13. In FIG. 13, the circuit 108 is comprised of a decoder DEC, an analogue switch AS and resistors R1 through R5. If the HECP signal is logic "1", the analogue switch AS is open. If the HECP signal is logic "0", a current flows through a resistor R5 and a corresponding one of the resistors R1 through R4, in accordance with the logic of the HE1 and HE2 signals. When the intensity of "W", "M", "S" or "VS" is specified by the HE1 and HE2 signals, the current flows respectively through the resistor R1, R2, R3 or R4, by means of the analogue switch AS. Returning to FIG. 11, in the analogue switch 109, a contact C is connected to a terminal ta when the logic of the HDP signal is "0" (see FIG. 9B). Contrary to this, the contact C is connected to a terminal tb during the hammering operation, while the contact C is connected to the terminal ta when the printing head 13-1 quickly returns to the hammer position for hammering the next type element 23, that is the line SI, P(SO) or PDW in FIG. 3, specified by the HP1, HP2 and HPS signals. The currents $I_1$ and $I_2$ (see FIG. 9B) for energizing the dc motor 21 are supplied from the terminal tb via an amplifier A2 and a motor driving amplifier 111. The current for quickly returning the printing head 13-1 to the hammer position, is supplied to the dc motor 21 via amplifier A1, terminal ta, amplifier A2 and the motor driving amplifier 111 until the output from the indicator 101 reaches zero. In principle, the peak amplitude of energizing current $I_2$ varies with the level P1, P2, P3 or P4 (see FIG. 9B), according to the specified intensity of the printing impact "W", "M", "S" or "VS", respectively, in which, the hammer position is located, for example, the floating stable position (see the dotted line P(SO) in FIG. 3). Occassionally, the hammer position is located at one of the other floating stable positions, such as the dotted lines PDW or SI in FIG. 3. In the embodiment of the present invention, as mentioned above, there are four hammer positions, namely hp1, hp2, hp3 and hp4, specified by the HP1 and HP2 signals (see FIG. 11), and also one idling position (see the line 0 in FIG. 3) specified by the HPS signal (see FIG. 11), for the purpose of performing very fine control of the intensity of the printing impact. One of the hammer positions hp1 through hp4 is selected according to both the location of the selected type element 23 (SO or SI) on the printing head 13-1 and the specified intensity of the printing impact ("W", "M", "S", "VS") with respect to this selected type element 23. The predetermined relation between the SO, SI, "W", "M", "V", "VS", and hp1 through hp4 may be clarified by the following Table.

TABLE

| | | | | |
|---|---|---|---|---|
| SO | "VS", | "S", | "M" | "W" |
| | | hp2 | | hp1 |

TABLE-continued

| | | | | |
|---|---|---|---|---|
| SI | "VS", | "S", | "M" | "W" |
| | | hp4 | | hp3 |

The location of hp1 is closest to the platen 12 (see FIG. 2), while location of hp4 is farthest from the platen 12, that is, closest to the idling position (see the line 0 in FIG. 3), hp2 and hp3 are located sequentially between hp1 and hp4.

Figure 14:
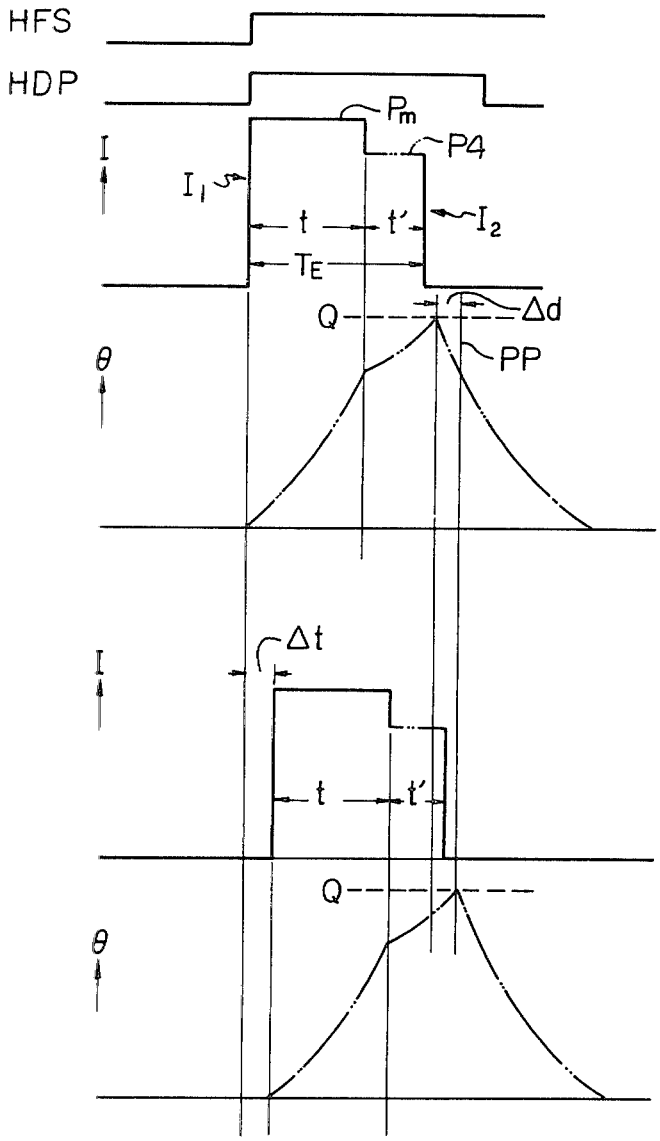
FIG. 14 contains explanatory waveforms for illustrating a first additional fine control employed in the double control mode.

In the embodiment of the present invention, the hammer timing and/or the hammer position may be slightly shifted by a predetermined value, in order to achieve an extremely fine control of the intensity of the printing impact. The shift of the hammer timing will be clarified by referring to FIG. 14, and the shift of the hammer position will be clarified by referring to FIG. 15. The waveforms denoted by the same symbols used in FIG. 9B, denote the same waveforms as in FIG. 9B. In FIG. 14, when the specified peak amplitude of the second energizing current $I_2$ is very high, such as the level P4, the printing head 13-1 often impacts on a printing position on the platen 12 which is different by a small distance $\Delta d$ from a predetermined printing position PP. In order to avoid the small printing position error $\Delta d$ the hammer energizing timing is shifted by $\Delta t$. Therefore, the printing position is adjusted to coincide with the predetermined printing position PP. The above mentioned shift of $\Delta d$ can be created by means of the circuit illustrated in FIG. 11. Referring to FIG. 11 when the hammer firing signal HFS is produced from the digital controller 100, the energizing pulse setting circuit 106 produces the hammer driving pulse HDP. In this case, if the HE1 and HE2 signals specify the intensity of the printing impact as "VS", the circuit 106 delays the time for producing the HDP signal by the shift time $\Delta t$.

Figure 15:
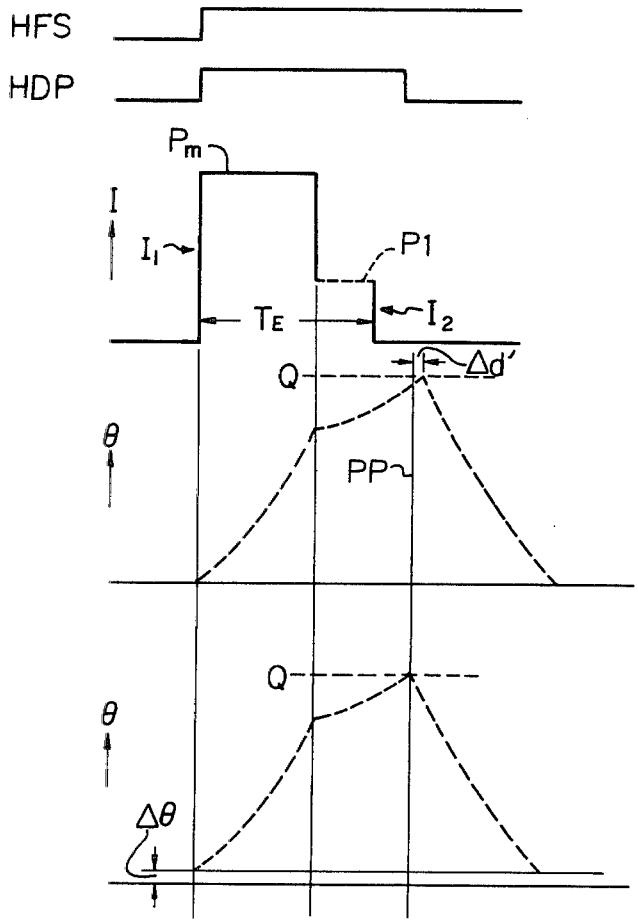
FIG. 15 contains explanatory waveforms for illustrating a second additional fine control employed in the double control mode.

In contrast, in FIG. 15, when the specified peak amplitude of the second energizing current $I_2$ is very low, such as the level P1, the printing head 13-1 often impacts on a printing position on the platen 12 which is different by a small distance $\Delta d'$ from a predetermined printing position PP. In order to avoid the small printing position error $\Delta d'$, the hammer position is shifted by a distance $\Delta\theta$ toward the platen 12. If, for example the intensity of "W" is specified with regard to the SI type element 23, the hammer position hp4 is not specified, as is in the above Table, but the hammer position hp3 is specified, so that the above shift $\Delta\theta$ is accomplished. That is, when the intensity of "W" is specified, the hammer position of the corresponding type elements 23 is forward to the platen 12 from the hammer position of type element 23 which is specified to impact on the platen 12 with the intensity of "M", "S" or "VS".

As explained above, the double control mode of the present invention is useful for realizing a very fine control of the printing impact, a compared to the prior single control mode, in a high speed printing system, especially a high speed printing system which is operated under the above described continuous printing method.

What is claimed is:

1. A high speed printing system, for printing on a record media, comprising:

means for providing printing data;

a platen for supporting the record media;

a carrier which traverses back and forth in parallel to the platen;

a printing head having a plurality of type elements, said printing head being mounted on the carrier, said printing head being selectively positioned in one of an idling position, an impact position located at said platen, and a floating stable position located between the idling position and the impact position;

first means for rotating the printing head so as to move a selected one of the type elements to a position facing the platen;

second means for hammering the printing head so that the selected type element impacts on the platen, said second means locating said printing head at the idling position when no printing data is being provided, said second means moving said printing head between the floating stable position and the impact position when successive printing data is being provided;

a third means for controlling a variable impact intensity of the selected type element to be applied to the platen said third means operating to supply at least a first energizing current and a second energizing current successively to the second means, said first energizing current having a maximum constant peak amplitude with respect to any of the type elements, and said second energizing current having a peak amplitude which varies in dependence upon the selected type element;

fourth means for spacing said carrier along the platen;

fifth means for supplying information to said third means, said information specifying the peak amplitude of the second energizing current, said information predetermined with respect to each type element; and sixth means for controlling said third means so as to vary the timing for supplying the second energizing current to said second means in dependence upon the selected type element.

2. A system as set forth in claim 1, wherein the second means comprises a dc motor.

3. A system as set forth in claim 1, wherein the second means commences hammering of the selected type element immediately before the time the fourth means finishes spacing each selected type element to a respective printing position on the platen.

4. A system as set forth in claim 1, wherein said sixth means comprises means for controlling said third means so as to shift a hammer timing of the second means, said hammer timing defined by a column shift time, the length of which varies in dependence upon the selected type element.

5. A system as set forth in claim 1, further comprising seventh means for controlling said third means so as to shift a hammering position from which said second means hammers the selected type element towards said platen by a predetermined distance, wherein said hammering position is defined by the floating stable position, in which the predetermined distance and the floating stable position vary in dependence upon the selected type element.

6. A system as set forth in claim 4, wherein said sixth means operates only when said third means supplies a second energizing current having a relatively high peak amplitude, whereby the hammer timing is delayed.

7. A system as set forth in claim 5, wherein said seventh means operates only when the third means supplies a second energizing current having a relatively low peak amplitude, whereby the hammering position is shifted toward the platen.

8. A system as set forth in claim 5, wherein said seventh means operates to shift the hammering position in dependence upon whether the selected type element is a shift-in type element or a shift-out type element.

9. A control circuit for a high speed printing system, having type elements and having a hammering means including a dc motor, comprising:

a digital controller circuit for providing first, second and third hammer position signals, first and second hammer energy specifying signals, and a hammer firing signal;

an energizing pulse setting circuit, operatively connected to said digital controller circuit, for receiving said hammer firing signal and said first and second hammer energy specifying signals and for providing, as an output, a hammer driving pulse signal;

a printing impact controller circuit, operatively connected to said energizing pulse setting circuit, for receiving said hammer driving pulse signal and for providing, as an output, a hammer energy controlling pulse signal;

a hammer energy specifying circuit, operatively connected to said digital controller circuit and said printing impact controller circuit, for receiving said first and second hammer energy specifying signals and said hammer energy controlling pulse signal and for providing, as an output, first and second energizing current signals;

a potentiometer, operatively connected to the dc motor for providing a displacement signal;

hammer control means, operatively connected to said digital controller circuit and said potentiometer, for receiving said first, second and third hammer position signals and said displacement signal and for providing a hammer velocity position signal; and analog switch means, operatively connected to said energizing pulse setting circuit, said hammer energy specifying circuit, said hammer control means, and the dc motor, for receiving said hammer driving pulse signal, said first and second energizing current signals, and said hammer velocity position signal, and for providing an output signal for driving the dc motor;

said analog switch means operating to supply at least said first energizing current signal and said second energizing current signal successively to the dc motor, the first energizing current signal having a maximum constant peak amplitude with respect to any of the type elements, and the second energizing current signal having a peak amplitude which is variable in dependence upon which of the type elements is selected.

10. A control circuit as set forth in claim 9, wherein said hammer energy specifying circuit comprises:

a decoder circuit, operatively connected to said digital controller circuit and said printing impact controller circuit, for receiving said hammer energy controlling pulse signal and said first and second hammer energy specifying signals and for providing first, second, third and fourth decoded signals;

an analog switch circuit, operatively connected to said decoder circuit for receiving said first, second, third and fourth decoded signals and for providing first, second, third, and fourth current signals when said hammer energy controlling pulse signal is low; and first, second, third, and fourth resistors, operatively connected between said analog switch circuit and said analog switch means, for providing said first and second energizing current signals to said analog switch means.

11. A control circuit as set forth in claim 9 or 10, wherein said hammer control means comprises:

a hammer position indicator circuit, operatively connected to said digital controller circuit, for receiving said first, second and third hammer position signals and for providing a position signal;

a differential amplifier, operatively connected to said hammer position indicator circuit and said potentiometer, for receiving said displacement signal and said position signal, and for providing a difference signal;

a hammer velocity detector circuit, operatively connected to said potentiometer, for differentiating said displacement signal to obtain a hammer velocity indicating signal; and a gain setting circuit, operatively connected to said differential amplifier, said hammer velocity detector circuit, and said analog switch means, for receiving said difference signal and said hammer velocity indicating signal, and for providing said hammer velocity position signal to said analog switch means.

12. A control circuit as set forth in claim 11, wherein said analog switch means comprises:

a first terminal operatively connected to said gain setting circuit;

a second terminal operatively connected to said hammer energy specifying circuit; and a contact, wherein said contact is connected to said first terminal when said hammer driving pulse signal is at a first logic level and wherein said contact is connected to said second terminal when said hammer driving pulse signal is at a second logic level.

13. A control circuit as set forth in claim 9 wherein said first and second hammer energy specifying signals vary in dependence upon the selected type element and wherein said energizing pulse setting circuit includes means for delaying the generation of the hammer driving pulse signal by a predetermined period of time after receiving the hammer firing signal, and wherein said predetermined period of time is varied in dependence upon said first and second hammer energy specifying signals.

14. A control circuit as set forth in claim 11, wherein said first and second hammer position signals vary in dependence upon the selected type element, and wherein said position signal is varied in dependence upon said first and second hammer position signals.

* * * * *

UNITED STATES PATENT AND TRADEMARK OFFICE

CERTIFICATE OF CORRECTION

PATENT NO. : 4,302,117

DATED : November 24, 1981

INVENTOR(S) : OSAMU TOMITA

It is certified that error appears in the above—identified patent and that said Letters Patent is hereby corrected as shown below:

Column 2, line 14, delete "mode" (first occurrence)

Column 7, line 30, "heat" should be --head--.

Column 9, line 59, after "the" insert --energizing--; and after "current" insert --for--.

Column 10, line 21, "$\theta$" should be --$\dot{\theta}$--;

line 37, "$\dot{\theta}$" should be --$\theta$--;

line 38, "$\dot{\theta}$m" should be --$\theta$m--;

line 41, "$\dot{\theta}$" should be --$\theta$--;

line 42, "$\dot{\theta}$1, $\dot{0}$2, $\dot{\theta}$3 and $\dot{0}$4" should be --$\theta$1, $\theta$2, $\theta$3 and $\theta$4--;

line 47, "$\theta$" (both occurrences) should be --$\dot{\theta}$--;

UNITED STATES PATENT AND TRADEMARK OFFICE

CERTIFICATE OF CORRECTION

PATENT NO. : 4,302,117

DATED : November 24, 1981

INVENTOR(S) : OSAMU TOMITA

It is certified that error appears in the above—identified patent and that said Letters Patent is hereby corrected as shown below:

line 49, "θ" (both occurrences) should be --$\dot{\theta}$--;

line 50, "θ2, θ3 and θ4" (first occurrences) should be --$\dot{\theta}$--.

Column 11, line 34, (Equation 2) "θ" should be --θ'--;

line 67, (Equation 6) "θ'" should be --$\dot{\theta}$'--.

Column 16, line 17, delete "a" (first occurrence).

*Column 18, line 48, after "9" insert --,--.

Signed and Sealed this

*Twenty-second* Day of *June 1982*

[SEAL]

*Attest:*

GERALD J. MOSSINGHOFF

*Attesting Officer*

*Commissioner of Patents and Trademarks*